US010677406B2

(12) United States Patent
Okubo

(10) Patent No.: US 10,677,406 B2
(45) Date of Patent: Jun. 9, 2020

(54) VEHICULAR LAMP

(71) Applicant: Ichikoh Industries, Ltd., Isehara-shi (JP)

(72) Inventor: Yasuhiro Okubo, Isehara (JP)

(73) Assignee: Ichikoh Industries, Ltd., Isehara-shi (JP)

( * ) Notice: Subject to any disclaimer, the term of this patent is extended or adjusted under 35 U.S.C. 154(b) by 0 days.

(21) Appl. No.: 16/094,331

(22) PCT Filed: Apr. 19, 2017

(86) PCT No.: PCT/JP2017/015805
§ 371 (c)(1),
(2) Date: Oct. 17, 2018

(87) PCT Pub. No.: WO2017/183674
PCT Pub. Date: Oct. 26, 2017

(65) Prior Publication Data

US 2019/0120453 A1 Apr. 25, 2019

(30) Foreign Application Priority Data

Apr. 21, 2016 (JP) ..... 2016-085509

(51) Int. Cl.
*F21S 41/141* (2018.01)
*F21S 43/00* (2018.01)
(Continued)

(52) U.S. Cl.
CPC ..... *F21S 41/141* (2018.01); *F21S 41/00* (2018.01); *F21S 41/285* (2018.01); *F21S 41/32* (2018.01); *F21S 41/635* (2018.01); *F21S 43/00* (2018.01)

(58) Field of Classification Search
CPC ..... F21V 13/04; F21V 7/04; F21V 7/09
(Continued)

(56) References Cited

U.S. PATENT DOCUMENTS

2010/0046243 A1 2/2010 Yatsuda
2010/0165653 A1* 7/2010 Ookubo ..... F21V 13/02 362/539

(Continued)

FOREIGN PATENT DOCUMENTS

JP 2004-87179 A 3/2004
JP 2010-49886 A 3/2010
JP 2013-20709 A 1/2013

OTHER PUBLICATIONS

International Search Report dated Jul. 18, 2017, in PCT/JP2017/015805, filed Apr. 19, 2017.

*Primary Examiner* — William J Carter
(74) *Attorney, Agent, or Firm* — Oblon, McClelland, Maier & Neustadt, L.L.P.

(57) ABSTRACT

The purpose of the present invention is to provide a vehicular lamp which creates light directed upward using a reflector that allows the light incident below the lower end of the lens to exit upward through a lens and which minimizes the uneven light distribution of the created light distribution pattern. The vehicular lamp according to the present invention includes: a semiconductor light source unit (20) including a light-emitting chip (21); a horizontally long lens (30) disposed in front of the light source unit (20); and a reflector (40) positioned between the lens (30) and light source unit (40) and disposed below the light-emitting chip (21) along a vertical direction. The reflector (40) includes a reflection surface (41) for creating a plurality of virtual focal points intersecting a vertical axis passing through the light emitting center O of the light-emitting chip (21). The distribution of light from the reflection surface (41) is controlled so that light is emitted from a light emitting surface (32) vertically below the optical axis Z of the lens (30). The lens (30) is formed such that, when a point light source is assumed on the optical axis Z, first direct light LM on the optical axis Z
(Continued)

10 emitted from the point light source is distributed upward from the light emitting surface (32).

8 Claims, 7 Drawing Sheets

(51) Int. Cl.
*F21S 41/00* (2018.01)
*F21S 41/63* (2018.01)
*F21S 41/20* (2018.01)
*F21S 41/32* (2018.01)

(58) Field of Classification Search
USPC ..... 362/459–549
See application file for complete search history.

(56) References Cited

U.S. PATENT DOCUMENTS

2015/0300590 A1* 10/2015 Huang ..... F21S 41/143
362/517
2016/0053967 A1* 2/2016 Owada ..... F21V 7/0091
362/520

* cited by examiner

[FIG. 1]
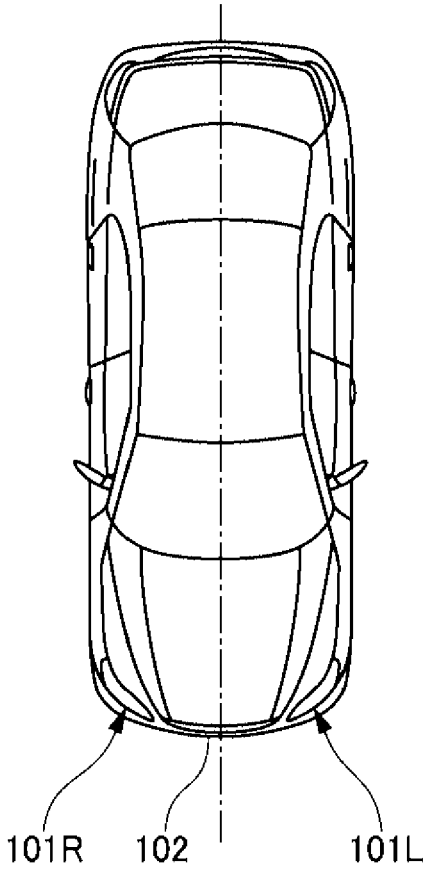

[FIG. 2]
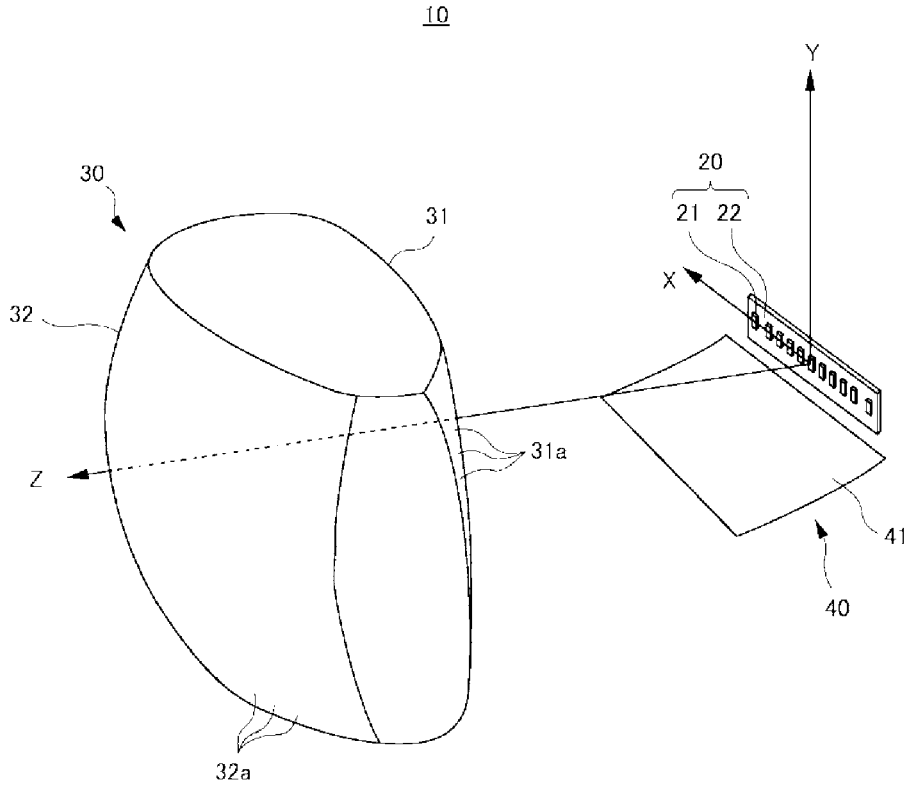

[FIG. 3]
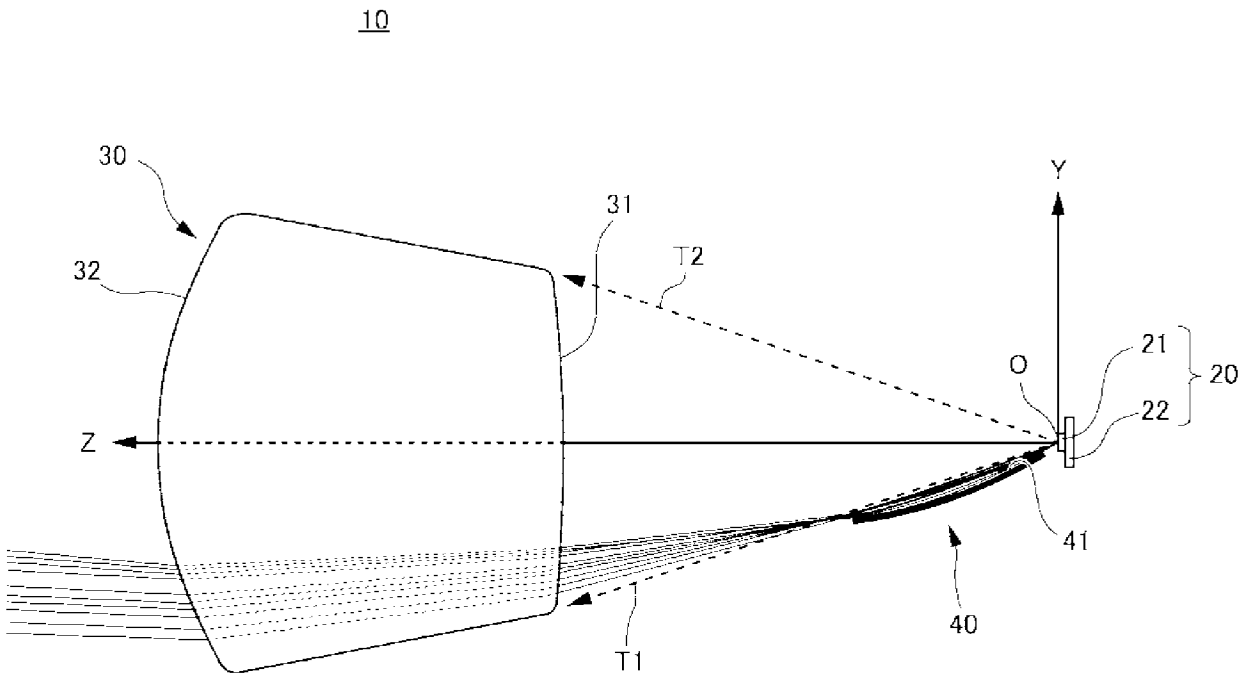

[FIG. 4]
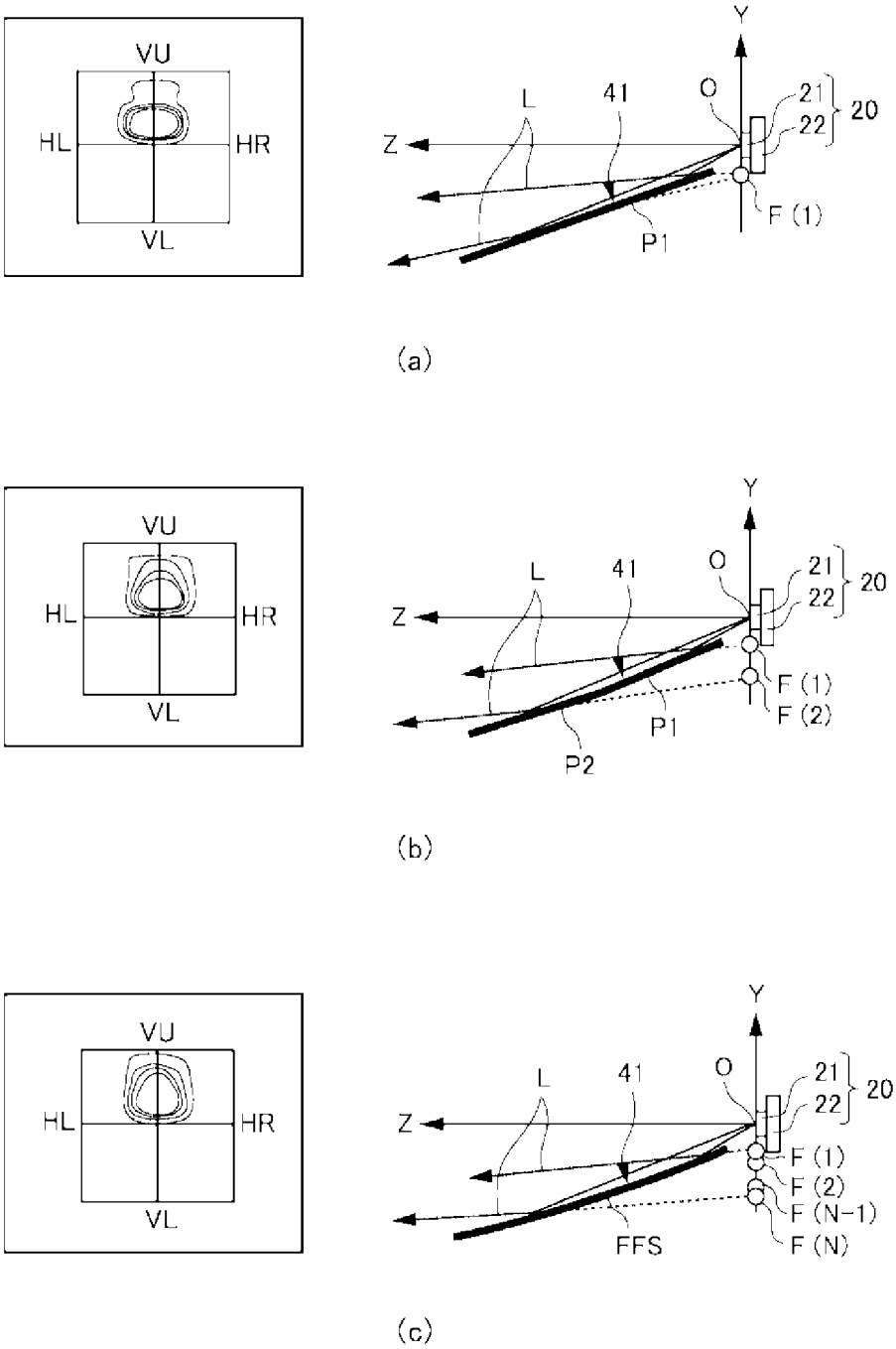

[FIG. 5]
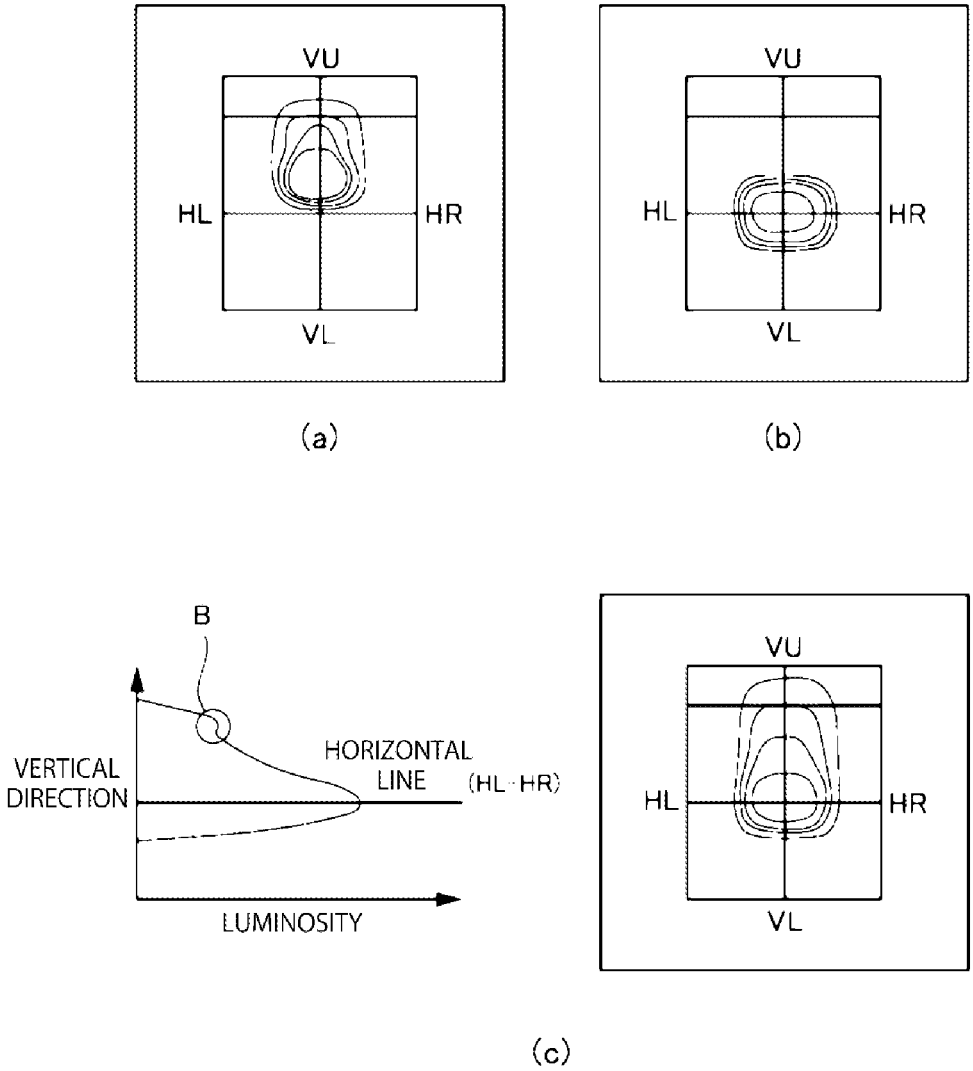

[FIG. 6]
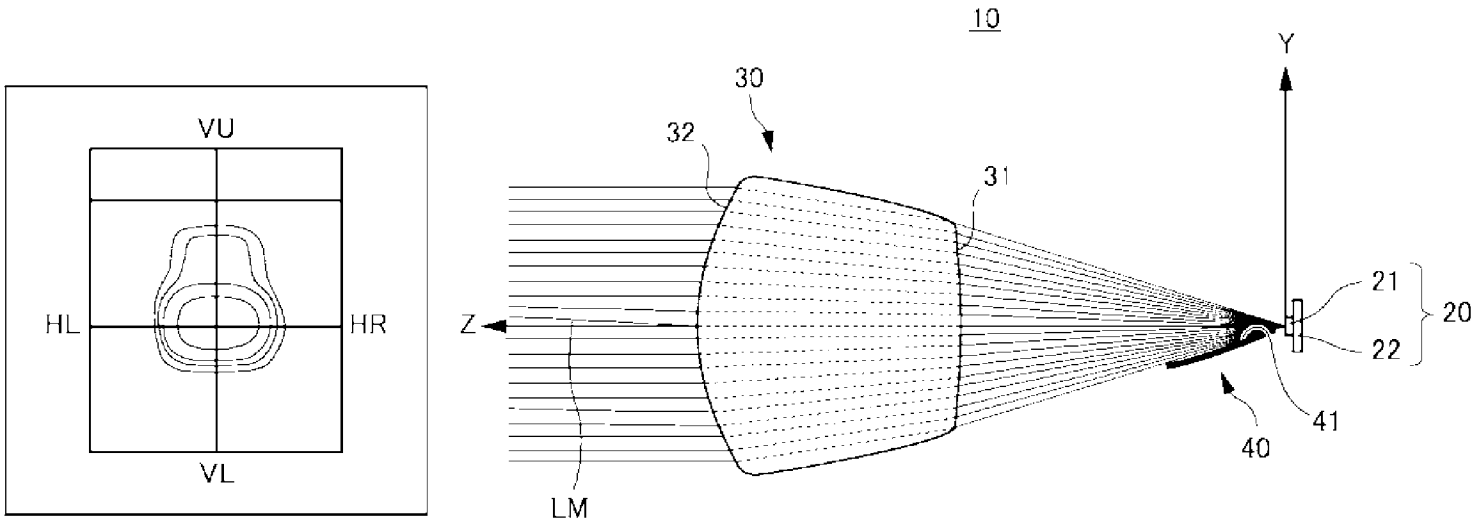

[FIG. 7]
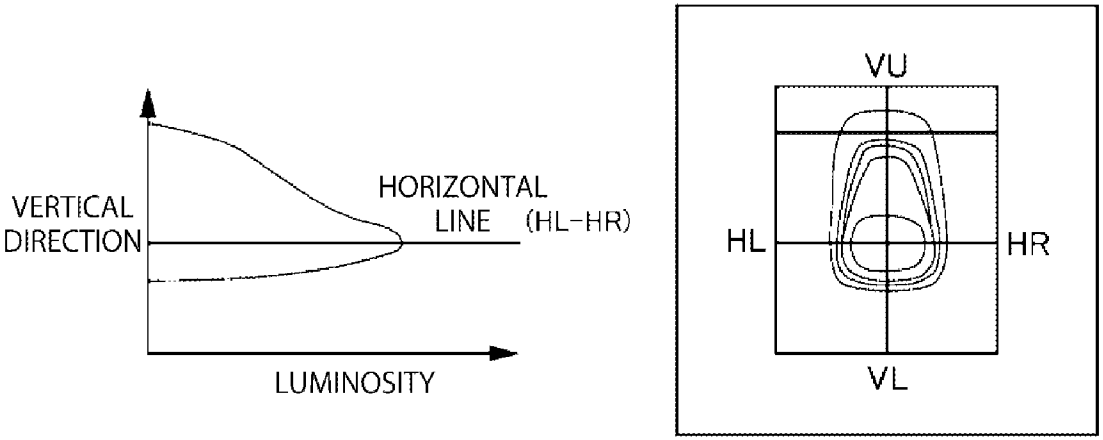

VEHICULAR LAMP

TECHNICAL FIELD

The present invention relates to a vehicular lamp.

BACKGROUND ART

In a vehicular front light capable of controlling an adaptive driving beam in which a light distribution pattern of a driving beam is adjusted in an adaptive manner, when presence of another vehicle such as a leading vehicle is detected and a light source that forms a central portion of the light distribution pattern is turned off, the light distribution pattern of the driving beam is produced in a state of being substantially equally divided into two in the left and right direction, which may give a driver an uncomfortable feeling. Therefore, PTL 1 discloses a vehicular front light that has reduced the above-described discomfort.

CITATION LIST

Patent Literature

PTL 1: Japanese Unexamined Patent Application Publication No. 2013-20709

SUMMARY OF THE INVENTION

Problems to be Solved by the Invention

Recently, vehicular lamps using horizontally long lenses of which length is shorter in the vertical direction than in the horizontal direction are required. When the length in the vertical direction is shortened, however, it becomes difficult to produce upper light in a light distribution pattern of a driving beam on an upper and lower sides of the lens.

Therefore, producing upper light by providing a reflector to reflect light, radiated from a light source unit more downward than a lower end of a lens, upwardly through the lens has been studied. The study has revealed a problem that light distribution unevenness occurs in the produced light distribution pattern.

The present invention has been made in view of these circumstances, and an object thereof is to provide a vehicular lamp that produces upper light by providing a reflector to reflect light, radiated from a light source unit more downward than a lower end of a lens, upwardly through the lens, and reduce light distribution unevenness in the produced light distribution pattern.

Solution to Problem

In order to achieve the above object, the present invention will be understood by the following configurations. (1) A vehicular lamp according to the present invention includes: a semiconductor light source unit having a light emitting chip; a lens disposed on a front side of the light source unit and is long in a horizontal direction; and a reflector disposed at a position between the lens and the light source unit and on a lower side of the light emitting chip in a vertical direction, wherein the reflector has a reflecting surface that forms a plurality of virtual focal points intersecting a vertical axis passing through a light emission center of the light emitting chip, the reflecting surface performs light distribution control for radiating light from a light emission surface lower than the lens optical axis in the vertical direction, and when a point light source is assumed on a lens optical axis, the lens is configured to perform light distribution control of first direct light on the lens optical axis from the point light source upward on the emitting surface.

(2) In the above configuration (1), the lens is configured to perform light distribution control for radiating the first direct light on the light emission surface within a range in the vertical direction in which light reflected on the reflecting surface is to be radiated.

(3) In the above configuration (1), the light source unit includes the plurality of light emitting chips arranged in the horizontal direction, the reflecting surface forms a plurality of virtual foci on the vertical axis of each of the light emitting chips, and when assuming the plurality of point light sources arranged in the horizontal direction on a horizontal cross section including the optical axis of the lens, the lens is configured to perform light distribution control of the first direct light group on the horizontal cross section including the lens optical axis from the plurality of point light sources upward on the light emission surface.

(4) In the above configuration (3), the lens is configured to perform light distribution control for radiating a first direct light group on the light emission surface within a range in the vertical direction in which light reflected on the reflecting surface is to be radiated.

(5) In the configuration of any one of (1) to (4) above, the reflecting surface is formed on a surface on which free-form curves on which the virtual focal points are in succession in the horizontal direction on the vertical axis to form a virtual focal line.

(6) In the configuration of any one of (1) to (5) above, micro diffusion elements that are raised strips that extend in the horizontal direction are formed in succession in the vertical direction on the incident surface, and the vertical cross section of the incident surface has asperities, and the micro diffusion elements are formed so that a projecting height of the raised micro diffusion elements is reduced from the height position of the lens optical axis toward a lower end side of the lens in the vertical direction.

(7) In the configuration of any one of (1) to (6) above, on the vertical cross section including a straight line parallel to the lens optical axis passing through the light emission center of the light emitting chip, the reflector is located at a position lower than a straight line in the vertical direction connecting the lower end side in the vertical direction of the effective incident surface of the lens on which the direct light from the light emitting chip enters and the light emission center of the light emitting chip.

(8) In the above configuration (7), at least a part of the reflector on the side of the lens is located at a position higher than, in the vertical direction, a straight line connecting a lower end side of the incident surface including a dummy surface of the lens and the light emission center of the light emitting chip.

Effect of the Invention

According to the present invention, a vehicular lamp that produces upper light by providing a reflector to reflect light, radiated from a light source unit more downward than a lower end of a lens, upwardly through the lens, and reduces light distribution unevenness in the produced light distribution pattern can be provided.

BRIEF DESCRIPTION OF THE DRAWINGS

FIG. 1 is a plan view of a vehicle provided with a vehicular lamp according to an embodiment of the present invention.

FIG. 2 is a perspective view of a main part of a lamp unit according to an embodiment of the present invention.

FIG. 3 is a cross-sectional view of a vertical section including a lens optical axis of a main part of a lamp unit according to an embodiment of the present invention.

FIG. 4 is a diagram for explaining that a reflection surface of according to an embodiment of the present invention reflects light radiated from a light emission center of a light emitting chip (a light emitting chip on an optical axis), in which (a) is a diagram illustrating a case in which the reflecting surface is formed by a single plane, (b) is a diagram illustrating a case in which the reflecting surface is formed by two planes, and (c) is a diagram illustrating a case in which the reflecting surface is formed by a free-form curved surface along a part of a surface of a free-form curved surface pillar according to the present embodiment.

FIG. 5 is an explanatory view of a light distribution pattern on a screen formed by light from a light emitting chip (a light emitting chip on an optical axis) located at the horizontal center of an embodiment of the present invention, in which (a) is a diagram illustrating a light distribution pattern formed by light reflected on a reflector, (b) is a diagram illustrating a light distribution pattern formed by direct light, and (c) is a diagram illustrating a light distribution pattern in which the light distribution patterns of (a) and (b) are multiplexed and a change in luminosity in the vertical direction at the center in the horizontal direction of the light distribution pattern.

FIG. 6 is an explanatory view of light distribution control for reducing light distribution unevenness of a lens according to an embodiment of the present invention.

FIG. 7 is an explanatory view of a light distribution pattern formed by multiplexing the light distribution pattern illustrated in FIG. 6 and the light distribution pattern illustrated in FIG. 5(*a*).

MODE FOR CARRYING OUT THE INVENTION

Hereinafter, modes for carrying out the present invention (hereinafter, simply referred to as "embodiments") will be described in detail with reference to the accompanying drawings. Like elements throughout the entire description of the embodiments will be denoted by like numerals. Also, unless otherwise noted, in the embodiments and drawings, "front" and "rear" "indicate a "forward direction" and a "reverse direction," respectively, of the vehicle, and "upper," "lower," left," and "right" all indicate directions from the viewpoint of a driver riding in the vehicle.

A vehicular lamp according to the embodiment of the present invention is a vehicular front light (101R, 101L) provided on the left and right sides, respectively, at the front of a vehicle 102 illustrated in FIG. 1, which will hereinafter simply be referred to as a vehicular lamp.

The vehicular lamp according to the present embodiment includes a housing (not illustrated) opened to the front of the vehicle and an outer lens (not illustrated) attached to the housing so as to cover the opening. A lamp unit 10 (see FIG. 2) etc. are arranged in a lamp chamber formed by the housing and the outer lens.

FIG. 2 is a perspective view illustrating a main part of the lamp unit 10.

In the drawings, as in the subsequent drawings, an X axis indicates the horizontal direction of the vehicle 102, a Y axis indicates the vertical direction of the vehicle 102, and a Z axis indicates a lens optical axis of a lens 30.0

As illustrated in FIG. 2, the lamp unit 10 includes a semiconductor light source unit 20 which has a light emitting chip 21, the lens 30 disposed in front of the light source unit 20 and is long in the horizontal direction (the X axis direction), and a reflector 40 disposed at a position between the lens 30 and the light source unit 20 and on the lower side of the light emitting chip 21 in the vertical direction.

The light source unit 20 and the reflector 40 are provided on a heat sink, which is not illustrated in FIG. 2, and the lens 30 is also attached to the heat sink via a lens holder.

Therefore, only the lens 30 which is the part that performs light distribution control is illustrated in FIG. 2. However, for example, a lens member having flanges to be held by the lens holder is formed at both ends in the horizontal direction (the X axis direction) of the lens 30 is used for the vehicular lamp.

Note that the positions at which the flanges are provided are not limited to the both ends in the horizontal direction (the X axis direction). and a method for attaching the lens 30 to the lens holder is arbitrary, such as fixing an end surface of the lens 30 around the lens 30 to the lens holder, etc. and is not particularly limited.

(Light Source Unit)

The light source unit 20 includes a substrate 22 and a plurality of light emitting chips 21 arranged on the substrate 22 so as to be aligned in the horizontal direction (the X axis direction). In the present embodiment, 11 light emitting chips 21 are arranged in the horizontal direction, and 11 light distribution patterns are formed by light emitted from each light emitting chip 21. These 11 light distribution patterns are arranged in the horizontal direction so as to partially overlap with at least adjacent light distribution patterns, and these light distribution patterns form an overall light distribution pattern.

In the present embodiment, the light emitting chip 21 positioned at the center in the horizontal direction among the light emitting chips 21 aligned in the horizontal direction is a light emitting chip on the optical axis located on the lens optical axis (see the Z axis) of the lens 30. However, there is a case that the lens optical axis (see the Z axis) of the lens 30 is located between the two light emitting chips 21 on the center side, and the light emitting chip 21 is not located on the lens optical axis (see the Z axis) of the lens 30. That is, the light emitting chips 21 do not necessarily have to be positioned on the lens optical axis (see the Z axis) of the lens 30.

Also, ADB (Adaptive Driving Beam) control of a driving beam light distribution pattern is performed by point turning on and off of some or all of the light emitting chips 21 in accordance with the positional relationship with the leading vehicle etc. In this manner, glare light with respect to a leading vehicle is reduced while radiating light forward.

In the present embodiment, a plurality of light emitting chips 21 are provided on a single substrate 22, but the light source unit may be formed by arranging light sources having a single light emitting chip on a single substrate arranged in a horizontal direction.

Further, although the semiconductor light source unit 20 in which an LED chip (light emitting diode chip) is used as the light emitting chip 21 is used in the present embodiment, the light emitting chip 21 is not limited to the LED chip, and an LD chip (laser diode chip) may be used. That is, the light source unit 20 may be a semiconductor light source unit using an LD chip in the light emitting chip 21. The shape of the light emitting chip 21 is not particularly limited, and may be a square or a rectangular. In addition, 11 light emitting chips 21 are used in the present embodiment, but the number of the light emitting chips 21 may be smaller than or greater than 11.

(Reflector)

The reflector 40 may be formed by a separate member and attached to a heat sink (not illustrated), or may be integrally formed with the heat sink when forming the heat sink.

FIG. 3 is a cross-sectional view of a vertical section including a lens optical axis (see the Z axis) of a main part of the lamp unit 10. FIG. 3 also illustrates light (light beams) reflected on the reflector 40 among the light radiated from a light emission center O of the light emitting chip 21 (a light emitting chip on the optical axis). FIG. 3 illustrates, as FIG. 2 does, only the part of the optically designed lens 30 which is a part that performs light distribution control. However, there is a case in which, due to the molding of the lens 30, the incident surface 31 may include a dummy surface which is not optically designed on the outsides in the vertical direction (on the upper and lower sides). However, in the following description, when merely described as an "incident surface 31," the surface means an effective incident surface not including a dummy surface unless otherwise stated that an effective incident surface (an optically designed incident surface) of the incident surface 31.

As illustrated in FIG. 3, in the present embodiment, the lens optical axis (see the Z axis) and the light emission center O of the light emitting chip 21 located at the center in the horizontal direction (the light emitting chip on the optical axis) among the light emitting chips 21 aligned in the horizontal direction match with each other. Also, on the vertical cross section including the lens optical axis (see the Z axis), dotted arrows T1 and T2 illustrated in FIG. 3 are drawn toward an upper end and a lower end of the effective incident surface of the incident surface 31 of the lens 30 on which the direct light from the light emission center O of the light emitting chip 21 located at the center in the horizontal direction (the light emitting chip on the optical axis) is incident.

The reflector 40 is located at a position, on the vertical cross section including the lens optical axis (see the Z axis), lower than a straight line (see a dotted arrow T1) connecting the light emission center O of the light emitting chip 21 (the light emitting chip on the optical axis) and a lower end of the effective incident surface of the incident surface 31 of the lens 30 between the lens 30 and the light source unit 20. That is, the reflector 40 is located at a position lower than a straight line in the vertical direction connecting the lower end side in the vertical direction of the effective incident surface of the lens 30 on which the direct light from the light emitting chip on the optical axis enters and the light emission center O on the optical axis. However, the light emitting chips 21 other than the light emitting chip on the optical axis also have the same relationship, on the vertical cross section including a straight line parallel to the lens optical axis (see the Z axis) passing through the light emission center O of the light emitting chip 21, the reflector 40 is located at a position lower than a straight line in the vertical direction connecting the lower end side in the vertical direction of the effective incident surface of the lens 30 on which the direct light from the light emitting chip 21 enters and the light emission center O of the light emitting chip 21.

More specifically, an upper end of the reflector 40, which is on the side of the light emitting chip 21 (the light emitting chip on the optical axis) which is the uppermost side in the vertical direction of the reflector 40 is located at a position lower in the vertical direction by 0.3 mm from the lower end in the vertical direction of the light emitting chip 21 (the light emitting chip on the optical axis) and an upper end of the reflector 40 is located in front of the light emitting chip 21 (the light emitting chip on the optical axis) by 1 mm. Aluminum vapor deposition is performed on a reflection surface 41 that reflects light so as to increase the reflectance.

As is understood from FIG. 3, among the light radiated from the light emitting chips 21 (the light emitting chips on the optical axis), the reflector 40 reflects, on the reflection surface 41 thereof, light radiated more downward than a straight line (see a dotted arrow T1) connecting the light emission center O of the light emitting chip 21 (the light emitting chip on the optical axis) and a lower end of the incident surface 31 (an effective incident surface) of the lens 30 toward the incident surface 31 (an effective incident surface) of the lens 30.

More specifically, the reflection surface 41 is formed to reflect light toward the position of the incident surface 31 of the lens 30 to be radiated with light from the light emission surface 32 on the lower side in the vertical direction (see the Y axis) of the lens optical axis (see the Z axis) of the lens 30, and the light reflected on the reflection surface 41 is radiated as upper light from the light emission surface 32 of the lens 30 and forms a light distribution pattern in a range approximately 6 degrees above a screen from a position on a substantially horizontal line on the screen.

The light reflected on the reflection surface 41 is originally light not incident on the effective incident surface of the lens 30 which is not used for forming the light distribution pattern. The reflector 40 uses the unused light to form the upper light to improve efficiency of light utilization.

Next, the reflection surface 41 will be described in more detail with reference to FIG. 4. FIG. 4 is a diagram for explaining that the reflection surface 41 reflects light radiated from the light emission center O of a light emitting chip 21 (a light emitting chip on an optical axis), in which (a) is a view illustrating a case in which the reflection surface 41 is formed by a single plane P1, (b) illustrates a case in which the reflecting surface is formed by two planes P1 and P2, and (c) is a diagram illustrating a case in which the reflecting surface is formed by a free-form curved surface FFS along a part of a surface of a free-form curved surface pillar according to the present embodiment.

In FIGS. 4(*a*), 4(*b*), and 4(*c*), each right diagram illustrates a state of light reflection on the reflection surface 41, and each left diagram illustrates, by equal luminosity lines, a state of the light distribution pattern formed by light reflected on the reflection surface 41 and projected on the screen via the lens 30.

A VU-VL line indicates a vertical line on the screen, and an HL-HR line indicates a horizontal line on the screen. Similarly, in the subsequent drawings illustrating the light distribution pattern on the screen, the VU-VL line indicates a vertical line on the screen, and the HL-HR line indicates the horizontal line on the screen.

The light emitting chip 21 located at the center in the horizontal direction (the light emitting chip on the optical axis) among the plurality of light emitting chips 21 is illustrated in FIG. 4, states of light distribution patterns themselves of other light emitting chips 21 are the same as that illustrated in FIG. 4. That is, as the position of the light emitting chip 21 is shifted in the horizontal direction, the position of the light distribution pattern on the screen to be formed is merely moved in the direction of the horizontal line.

As illustrated in FIG. 4(*a*), when the reflection surface 41 is formed by a single plane P1, a large amount of light (a large number of light rays) emitted from the light emission center O are reflected at respective positions on the reflection surface 41. When the reflected light is extended toward the vertical axis (see the Y axis) passing through the light emission center O of the light emitting chip 21 (the light emitting chip on the optical axis), a virtual focal point that intersects with the vertical axis (see the Y axis) is focused on a single point F(1).

This means that one pseudo light source having a light emission center exists at the virtual focal point F(1), which is equivalent to that the light from the pseudo light source is radiated upward through the lens 30. Therefore, as is understood from the light distribution pattern illustrated on the left diagram of FIG. 4(*a*), a relatively focused light distribution pattern appears.

On the other hand, as illustrated in FIG. 4(*b*), when the reflection surface 41 is formed by two planes P1 and P2 of different angles, a virtual focal point F(1) of light to be reflected on the plane P1 and a virtual focal point F(2) of light to be reflected on the plane P2 are formed to be arranged in the vertical direction on the vertical axis (see the Y axis).

This means that two pseudo light sources, i.e., one pseudo light source having the light emission center existing at the virtual focal point F(1) and one pseudo light source having the light emission center existing at the virtual focal point F(2), which is equivalent to that light from the two pseudo light sources arranged in the vertical direction are radiated upward through the lens 30.

A difference in position of the pseudo light sources in the vertical direction appears as a difference in position in which the light distribution pattern is formed in the vertical direction. Therefore, as is understood from the light distribution pattern illustrated in the left diagram of FIG. 4(*b*), the light distribution patterns formed by multiplexing the light distribution patterns formed by the two pseudo light sources expands on an upper side in the vertical direction.

From this, when surfaces having different angles are provided on the reflection surface 41 so as to form a virtual focal point located further below the vertical direction, the light distribution pattern formed on the screen can be further expanded upward in the vertical direction.

In order to prevent the light distribution pattern on the screen formed by the pseudo light sources from having light distribution unevenness, light distribution patterns of which positions are shifted little by little in the vertical direction upward may be multiplexed. For this purpose, the virtual focal points may be formed in a continuous manner to form a virtual focal line.

Thus, in the present embodiment, as illustrated in FIG. 4(*c*), the reflection surface 41 is formed by the free-form curved surface FFS, and virtual foci F(1), F(2), . . . , F (N−1), and F(N) are formed in a continuous manner on the vertical axis (see the Y axis). Therefore, a virtual focal line is formed.

In the present embodiment, a plurality of light emitting chips 21 other than the light emitting chips on the optical axis aligned in the horizontal direction are also in the same state. Therefore, when viewed as the entire surface of the reflection surface 41, the reflection surface 41 is formed so as to be a free-form curved surface FFS along a part of the surface of the free-form surface pillar, that is, a surface in which free-form curves are continuous in the horizontal direction.

In this manner, when the reflection surface 41 is formed by the free-form curved surface FFS, as in the light distribution pattern illustrated in the left diagram of FIG. 4C, a light distribution pattern expanding on the upper side in the vertical direction and with reduced light distribution unevenness can be formed.

However, the reflection surface 41 does not necessarily have to be a free-form curved surface FFS, and the reflection surface 41 only needs to be able to create a state in which a necessary number of pseudo light sources are present side by side in the vertical direction. That is, the reflection surface 41 may have a plurality of virtual focal points intersecting the vertical axis which are formed as required.

In the above, when the light reflected on the reflection surface 41 is extended toward the vertical axis (see the Y axis) passing through the light emission center O of the light emitting chip 21, the reflection surface 41 forms a vertical focal line that intersects the vertical axis (see the Y axis) is described as a representative of the light emitting chip 21 that is the light emitting chip on the optical axis. As described above, however, the reflection surface 41 becomes the same state with respect to the light emitting chips 21 other than the light emitting chip on the optical axis, and when the light of each of the light emitting chips 21 reflected on the reflection surface 41 is extended toward the vertical axis (see the Y axis) passing through the light emission center O of each light emitting chip 21, the reflection surface 41 forms a virtual focal line that intersects the vertical axis (see the Y axis).

Also, as described with reference to FIG. 3, the reflector 40 is located on the lower side of a straight line (see the dotted arrow T1) connecting the light emission center O of the light emitting chip 21 (the light emitting chip on the optical axis) and a lower end side of the effective incident surface of the incident surface 31 in the vertical direction. Regarding the incident surface 31 including the dummy surface, at least a part of the reflector 40 on the side of the lens 30 is located at a position higher than, In the vertical direction, a straight line connecting a lower end side of the incident surface 31 including the dummy surface of the lens 30 and the light emission center O of the light emitting chip 21 (the light emitting chip on the optical axis). However, the light emitting chips 21 other than the light emitting chip on the optical axis also have the same relationship, at least a part of the reflector 40 on the side of the lens 30 is located at a position higher than, In the vertical direction, a straight line connecting a lower end side of the incident surface 31 including the dummy surface of the lens 30 and the light emission center O of the light emitting chip 21.

(Lens)

The lens 30 is made of transparent resin material such as polycyclohexylene dimethylene terephthalate (PCT), polycarbonate (PC), or an acrylic resin such as PMMA, etc. From the viewpoint of processability etc., the lens 30 is desirably made of transparent resin. Among resins, acrylic resin having small wavelength dependency of the refractive index and capable of reducing the influence of spectroscopy is desirably used.

The lens 30 is formed into a horizontally long shape, which is shorter in the vertical direction to fulfill recent demands. In the present embodiment, the lens 30 has a vertical dimension of 30 mm±10 mm and a horizontal direction is about 55 mm. As the shape of the lens 30, the dimension of the lens 30 in the horizontal direction is preferably 55 mm or less.

Also, in the present embodiment, both of the incident surface 31 and the light emission surface 32 of the lens 30 are convex formed by free-form curved surfaces, and each the rear focal length is about 30 mm±5 mm. Therefore, the lens 30 is attached to a heat sink (not illustrated) by a lens holder (not illustrated) so that a protruding part of the incident surface 31 to a side closest to the light source unit 20 is located approximately 30 mm forward from the light emitting chip 21 (the light emitting chip on the optical axis).

FIG. 5 is an explanatory view of a light distribution pattern on a screen formed by light from the light emitting chip 21 located at the horizontal center (the light emitting chip on an optical axis), in which (a) is a diagram illustrating a light distribution pattern formed by the light reflected on the reflector 40, (b) is a diagram illustrating a light distribution pattern formed by direct light, and (c) is a diagram illustrating a light distribution pattern formed by light from the light emitting chip 21 (a light emitting chip on the optical axis) in which the light distribution patterns of (a) and (b) are multiplexed. In addition, in FIG. 5(*c*), the change in luminosity in the vertical direction at the center in the horizontal direction of the light distribution pattern is also illustrated on the left side.

It is to be noted that FIG. 5(*a*) extends upward in the vertical direction from the light distribution pattern illustrated in FIG. 4(*c*). This is because FIG. 4(*c*) illustrates a light distribution pattern formed by light emitted from the light emission center O of the light emitting chip 21 (the light emitting chip on the optical axis), whereas FIG. 5(*a*) illustrates a light distribution pattern formed by light radiated from the entire light emitting surface and reflected on the reflector 40. The light distribution pattern illustrated in FIG. 5(*c*) is a pattern before the lens 30 is subject to improvement for reducing light distribution unevenness described later.

As illustrated in FIG. 5, the light distribution pattern (see FIG. 5(*c*)) formed by light from the light emitting chip 21 (the light emitting chip on the optical axis) is formed by superposing a light distribution pattern formed by the light reflected on the above-described reflector 40 and incident on the lens 30 (see FIG. 5(*a*)) and a light distribution pattern formed by direct light incident on the lens 30 directly from the light emitting chip 21 (the light emitting chip on the optical axis) (see FIG. 5(*b*)).

As is understood from the left diagram of FIG. 5(*c*) illustrating the change in luminosity, light distribution unevenness (see a circled portion B) in which the luminosity sharply changes appears. Therefore, the lens 30 according to the present embodiment performs light distribution control to reduce such occurrence of light distribution unevenness, which will be described in detail below.

FIG. 6 is an explanatory view of light distribution control for reducing uneven light distribution of the lens 30. The right diagram is a sectional view of a vertical cross section similar to that of FIG. 3 and illustrates direct light incident on the lens 30 from the light emitting chip 21 (the light emitting chip on optical axis). The left diagram illustrates a light distribution pattern formed by direct light incident on the lens 30 from the light emitting chip 21 (the light emitting chip on optical axis) illustrated on the right diagram.

As illustrated in the right diagram of FIG. 6, the lens 30 is arranged such that the first direct light (see the light beam LM) on the lens optical axis (see the Z axis) from the light emitting chip 21 (the light emitting chip on the optical axis) on the lens optical axis (see the Z axis) is radiated upward at a portion of the light emission surface 32 which intersects the lens optical axis (see the Z axis). More specifically, the light distribution control is performed so that the first direct light from the light emitting chip 21 passing through the lens optical axis (see the Z axis) is radiated on the screen by about 3.5 degrees above the horizontal line.

As described above, there are cases in which there is no light emitting chip 21 (light emitting chip on the optical axis) located on the lens optical axis (see the Z axis), but the same lens can also be used in this case. Therefore, when assuming a point light source on the lens optical axis (see the Z axis), the lens 30 may perform light distribution control of first direct light (see the light beam LM) on the lens optical axis (see the Z axis) from the point light source upward at the light emission surface 32.

The reflected light reflected on the reflection surface 41 of the reflector 40 in the most vertical direction via the lens 30 is radiated on the screen toward about 6 degrees above the horizontal line. Therefore, the first direct light (see the light beam LM) from the light emitting chip 21 (the light emitting chip on the optical axis) passing through the lens optical axis (see the Z axis) is radiated upward, while is radiated on the lower side in the vertical direction than the light reflected on the reflection surface 41 and radiated most upward from the light emission surface 32 of the lens 30.

This is because the first direct light (see the light beam LM) from the light emitting chip 21 (the light emitting chip on the optical axis) passing through the lens optical axis (see the Z axis) radiated upward is radiated to compensate for the luminosity of the light distribution unevenness illustrated in the left diagram of FIG. 5(*c*) (see a circled portion B). For this, the lens 30 is configured to perform light distribution control for radiating the first direct light (see the light beam LM) on the light emission surface 32 within the range in the vertical direction on the screen on which the light reflected on the reflection surface 41 of the reflector 40 is to be radiated.

In the present embodiment, the same light distribution control is performed not only with the light from the light emitting chip 21 located at the center in the horizontal direction illustrated in FIG. 6 (the light emitting chip on the optical axis), but also with the light from other light emitting chips 21.

Therefore, when designing a plurality of point light sources arranged on a horizontal cross section including the lens optical axis (see the Z axis) in terms of design, the lens 30 of the present embodiment is formed to perform light distribution control of the first direct light group on the horizontal cross section including the lens optical axis (see the Z axis) from the plurality of point light sources upward on the light emission surface 32, and the light traveling toward the portion of the light emission surface 32 on the horizontal line that intersects the lens optical axis (see the Z axis) from the light emission center O of each light emitting chip 21 is subject to light distribution control upward at the portion of the light emission surface 32 on the horizontal line that intersects the lens optical axis (see the Z axis). More specifically, the lens 30 is formed such that the surface shape of the light emission surface 32 on the horizontal line intersecting the lens optical axis (see the Z axis) radiates the light upward in the vertical direction in a range of a minute section (a minute width).

Originally, the light radiated from the light emission surface 32 on the horizontal line intersecting the lens optical axis (see the Z axis) enters the incident surface 31 substantially rightly from each light emitting chip 21, passes through the lens 30 almost rightly, and is radiated substantially rightly forward from the light emission surface 32. In this way, the light radiated without much refraction by the lens 30 has high controllability with respect to the change of the surface, and can be radiated upward by the surface control in the minute section.

When the light emitted from a position apart from the horizontal line intersecting the lens optical axis (see the Z axis) outwards in the vertical direction on the light emission surface 32 is to be subject to upward control, the refraction state of surrounding light is affected by the influence of the surface control therefore, which may easily cause influences on the shape etc. of the light distribution pattern. Therefore, the light radiated from the light emission surface 32 on the horizontal line intersecting the lens optical axis (see the Z axis) is desirably controlled to be radiated upward. When such light distribution control is performed, as illustrated in the left diagram of FIG. 6, a light distribution pattern expanded slightly upward in the vertical direction slightly higher as compared with the state of the light distribution pattern illustrated in FIG. 5(*b*) is formed.

Then, the light distribution pattern formed by multiplexing the light distribution pattern formed by direct light from the light emitting chip 21 (the light emitting chip on the optical axis) illustrated in the left diagram of FIG. 6 and the light distribution pattern formed by the light reflected on the reflector 40 illustrated in FIG. 5(*a*) becomes the light distribution pattern illustrated in FIG. 7. In FIG. 7 as in FIG. 5(*c*), the right diagram illustrates the light distribution pattern on the screen with equal luminosity lines, and the left diagram illustrates changes in luminosity in the vertical direction at the horizontal center of the light distribution pattern.

As is understood by comparing the right diagram of FIG. 7 with the right diagram of FIG. 5(*c*), the light distribution pattern illustrated in the right diagram of FIG. 7 is substantially the same as the light distribution pattern illustrated in the right diagram of FIG. 5(*c*). As is understood by comparing the left diagram of FIG. 7 with the left diagram of FIG. 5(*c*), light distribution unevenness as illustrated by the circled portion B in FIG. 5(*c*) does no more exist in the left diagram of FIG. 7, indicating that luminosity is improved.

As described above, the lens 30 performs the light distribution control of radiating the light upward regarding light radiated from the portion of the light emission surface 32 on the horizontal line intersecting the lens optical axis (see the Z axis) in the same manner, the lens 30 also performs light distribution control for radiating light upward about the light from other light emitting chips 21 than the light emitting chip on the optical axis. Therefore, the light distribution pattern formed by the direct light from the light emitting chip 21 other than the light emitting chip on the optical axis is also the light distribution pattern that is the same as that of the light distribution pattern formed by direct light from the light emitting chip on the optical axis merely by shifting the position in the horizontal direction on the screen.

In the vehicular lamp of the present embodiment, the light distribution patterns formed by the light from the plurality of light emitting chips 21 are arranged in the horizontal direction and partly overlap one another and form a light distribution pattern as a vehicular lamp.

Therefore, at boundaries where the light distribution patterns formed by the light from each light emitting chip 21 overlap each other, streaks may appear due to difference in luminosity. In order to reduce the appearance of the streaks, micro diffusion elements 31*a* and micro diffusion elements 32*a* are provided on the incident surface 31 and the light emission surface 32 in the lens 30 of the present embodiment. Hereinafter, the micro diffusion elements 31*a* and the micro diffusion elements 32*a* will be briefly described.

As illustrated in FIG. 2, micro diffusion elements 32*a* that are raised strips that extend in the vertical direction (the Y axis direction) are formed in succession in the horizontal direction (the X axis direction) on the light emission surface 32. Each of the micro diffusion elements 32*a* has a semi-cylindrical prism shape, so the light emission surface 32 has the shape of a series of gently wavy asperities in the horizontal direction (the X axis direction).

Similarly, micro diffusion elements 32*a* that are raised strips that extend in the horizontal direction (the X axis direction) are formed in succession in the vertical direction (the Y axis direction) on the incident surface 31. Therefore, the vertical cross section of the incident surface has asperities. The micro diffusion elements 31*a* may be provided on the entire incident surface 31 including the dummy surface or may be provided only on the effective incident surface of the incident surface 31 not including the dummy surface. Each of the micro diffusion elements 31*a* formed on the incident surface 31 has a shape like a semi-circular prism, so that gradual wave-like asperities appear continuously in the vertical direction (the Y axis direction) on the light emission surface 32.

When such micro diffusion elements 31*a* and micro diffusion elements 32*a* are provided, light incident from the incident surface 31 expands in the vertical direction (the Y axis direction), so the formed light distribution pattern is blurred in the vertical direction (the Y axis direction), and light emitted from the light emission surface 32 expands in the horizontal direction (the X axis direction), so the formed light distribution pattern is blurred in the horizontal direction (the X axis direction). In this way, the light distribution pattern formed by each light emitting chip 21 is respectively blurred, so streaks due to a difference in luminosity may appear at the boundary lines of the overlapping light distribution patterns do not tend to occur.

Here, since the light emission surface 32 has a convex shape on the front thereof, each of the micro diffusion elements 32*a* formed on the light emission surface 32 has curved inclination as it inclines upward from the front side to the rear side on the upper side in the vertical direction (the Y axis direction) with reference to the position of the horizontal line intersecting the lens optical axis (see the Z axis) of the lens 30, and has curved inclination as it inclines downward from the front side toward the rear side on the lower side of the lens 30 in the vertical direction (the Y axis).

Consequently, there are cases with the light distribution pattern formed by the light radiated from the upper side of the lens 30 where the horizontal end side of the light distribution pattern drops below the center. Conversely, there are cases with the light distribution pattern formed by the light radiated from the lower side of the lens 30 where the horizontal end side of the light distribution pattern rises above the center.

Therefore, the micro diffusion elements 32*a* formed on the light emission surface 32 are desirably such that the width of the raised strips becomes smaller toward the vertical outsides (on the upper and the lower sides) with reference to the position of the horizontal line that intersects the lens optical axis (see the Z axis). That is, the micro diffusion elements 32*a* formed on the light emission surface 32 are desirably formed such that the width of the semi-cylindrical prism shape gradually smaller from the position of the horizontal line intersecting the lens optical axis (see the Z axis) toward the upper and the lower sides in the vertical direction.

In this manner, both end portions of an arc-shaped cross-section of the micro diffusion elements 32*a* are corrected in the direction for radiating the light upward as it goes toward the upper side in the vertical direction of the lens 30, so the ends of the light distribution pattern are inhibited from dropping downward. Similarly, the micro diffusion elements 32*a* are formed such that both end portions of the arc-shaped cross-section are corrected in the direction in which light is radiated downward increasingly toward the lower side of the lens 30, so the ends of the light distribution pattern are inhibited from rising upward. Therefore, a good light distribution pattern in which no dropping or rising occurs at both ends of the light distribution pattern is able to be formed.

Referring to FIG. 3, as described above, the light reflected on the reflection surface 41 of the reflector 40 is reflected toward the position of the incident surface 31 of the lens 30 to be radiated with light from the light emission surface 32 below the lens optical axis (see the Z axis) of the lens 30 in the vertical direction (see the Y axis). Therefore, the reflection surface 41 reflects light toward the lower side in the vertical direction of the incident surface 31. As described above, light distribution of the reflection surface 41 is basically designed such that the light reflected on the reflection surface 41 is emitted from the light emission surface 32 on the lower side of the lens optical axis (see the Z axis) of the lens 30 in the vertical direction (see the Y axis). However, a part of the light reflected on the reflection surface 41 may be emitted from the light emission surface 32 on the upper side of the lens optical axis (see the Z axis) in the vertical direction (see the Y axis) due to variations, etc. on the reflection surface 41.

The micro diffusion elements 31*a* on the incident surface 31 expand the light in the vertical direction. Therefore, when the light reflected on the reflection surface 41 is incident on the incident surface 31 and widely diffused in the vertical direction by the micro diffusion elements 31*a*, a part of the diffused light is radiated toward the light emission surface 32 (the light emission surface 32 on the horizontal line intersecting the optical axis of the lens) that distributes the first direct light group including the above first direct light upward.

However, light distribution control of the light emission surface 32 on the horizontal line that intersects the lens optical axis is performed by the light traveling along the lens optical axis (see the Z axis) that goes substantially straight from each light emitting chip 21 as described above, when the light from a direction other than the above-described direction is radiated from the light emission surface 32 on the horizontal line intersecting the lens optical axis, a favorable state of light luminosity is not easily obtained. Therefore, the micro diffusion elements 31*a* provided on the incident surface 31 are desirably formed so as not to be radiated from the light emission surface 32 on the horizontal line where the light reflected on the reflector 40 crosses the lens optical axis (see the Z axis).

Therefore, in the present embodiment, the micro diffusion elements 31*a* on the incident surface 31 are located at least in a range from the height position (the height position in the vertical direction) of the lens optical axis (see the Z axis) to the lower side, a protrusion height of the raised micro diffusion elements 31*a* is reduced from the height position of the lens optical axis toward the lower end side of the lens 30, and the diffusion amount of the micro diffusion elements 31*a* at the position of the incident surface 31 at which the light reflected on the reflector 40 is incident is reduced.

Although the present invention has been described based on specific embodiments, the present invention is not limited to above embodiment. Modifications and improvements that do not depart from the technical aspects are also included in the technical scope of the invention, and this is evident from the description of the scope of the claims for patent.

DESCRIPTION OF REFERENCE NUMERALS

10 Lamp unit
20 Light source unit
21 Light emitting chip
22 Circuit board
30 Lens
31 Incident surface
31*a* Micro diffusion elements
32 Light emission surface
32*a* Micro diffusion elements
40 Reflector
41 Reflecting surface
X Axis indicating horizontal direction
Y Axis indicating vertical direction
Z Lens optical axis
F(1) Virtual focal point
F(2) Virtual focal point
F(N−1) Virtual focal point
F(N) Virtual focal point
O Light emission center
P1, P2 Planes
FFS free-form curved surface
LM Light beam
101L, 101R Vehicular front lights
102 Vehicle

The invention claimed is:

1. A vehicular lamp, comprising;

a semiconductor light source unit having a light emitting chip;

a lens disposed on a front side of the light source unit and is long in a horizontal direction; and a reflector disposed at a position between the lens and the light source unit and on a lower side of the light emitting chip in a vertical direction, wherein the reflector has a reflecting surface that forms a plurality of virtual focal points intersecting a vertical axis passing through a light emission center of the light emitting chip, the reflecting surface performs light distribution control for radiating light from a light emission surface of the lens, lower than a lens optical axis, in the vertical direction, and for first direct light on the lens optical axis from the light emitting chip arranged on the lens optical axis, the lens performs light distribution control of the first direct light to direct the first direct light upward above the lens optical axis from the light emission surface.

2. The vehicular lamp according to claim 1, wherein the lens is configured to perform light distribution control for radiating the first direct light on the light emission surface within a range in the vertical direction in which light reflected on the reflecting surface is to be radiated.

3. The vehicular lamp according to claim 1, wherein the light source unit includes the plurality of light emitting chips arranged in the horizontal direction, the reflecting surface forms a plurality of virtual foci on the vertical axis of each of the light emitting chips, and the plurality of the light emitting chips are arranged in the horizontal direction on a horizontal cross section including the optical axis of the lens, the lens performs light distribution control of a first direct light group on the horizontal cross section including the lens optical axis from the plurality of point light sources to direct the first direct light group upward above the lens optical axis from the light emission surface.

4. The vehicular lamp according to claim 3, wherein the lens is configured to perform light distribution control for radiating the first direct light group on the light emission surface within a range in the vertical direction in which light reflected on the reflecting surface is to be radiated.

5. The vehicular lamp according to claim 1, wherein the reflecting surface is formed on a surface on which free-form curves on which the virtual focal points are in succession in the horizontal direction on the vertical axis to form a virtual focal line.

6. The vehicular lamp according to claim 1, wherein micro diffusion elements that are raised strips that extend in the horizontal direction are formed in succession in the vertical direction on the incident surface, and the vertical cross section of the incident surface has asperities, and the micro diffusion elements are formed so that a projecting height of the raised micro diffusion elements is reduced from the height position of the lens optical axis toward a lower end side of the lens in the vertical direction.

7. The vehicular lamp according to claim 1, wherein, on the vertical cross section including a straight line parallel to the lens optical axis passing through the light emission center of the light emitting chip, the reflector is located at a position lower than a straight line in the vertical direction connecting the lower end side in the vertical direction of the effective incident surface of the lens on which the direct light from the light emitting chip enters and the light emission center of the light emitting chip.

8. The vehicular lamp according to claim 7, wherein, at least a part of the reflector on the side of the lens is located at a position higher than, in the vertical direction, a straight line connecting a lower end side of the incident surface including a dummy surface of the lens and the light emission center of the light emitting chip.

* * * * *